US010643785B2

(12) United States Patent
Yang et al.

(10) Patent No.: US 10,643,785 B2
(45) Date of Patent: May 5, 2020

(54) THIN FILM TYPE COIL COMPONENT

(71) Applicant: SAMSUNG ELECTRO-MECHANICS CO., LTD., Suwon-si, Gyeonggi-do (KR)

(72) Inventors: Ju Hwan Yang, Suwon-si (KR); Young Seuck Yoo, Suwon-si (KR); Seok Il Hong, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 0 days.

(21) Appl. No.: 15/474,619

(22) Filed: Mar. 30, 2017

(65) Prior Publication Data

US 2018/0061552 A1 Mar. 1, 2018

(30) Foreign Application Priority Data

Aug. 23, 2016 (KR) ..... 10-2016-0107212

(51) Int. Cl.

| | |
|---|---|
| ***H01F 5/00*** | (2006.01) |
| ***H01F 27/29*** | (2006.01) |
| ***H01F 17/00*** | (2006.01) |
| ***H01F 17/04*** | (2006.01) |

(52) U.S. Cl.

CPC ..... *H01F 27/292* (2013.01); *H01F 17/0013* (2013.01); *H01F 17/04* (2013.01); *H01F 2017/048* (2013.01)

(58) Field of Classification Search

USPC ..... 336/200, 232, 83

See application file for complete search history.

(56) References Cited

U.S. PATENT DOCUMENTS

| | | | | |
|---|---|---|---|---|
| 2010/0157565 | A1* | 6/2010 | Yoshida | H01F 27/292 361/811 |
| 2010/0259352 | A1* | 10/2010 | Yan | H01F 5/003 336/200 |
| 2010/0301966 | A1* | 12/2010 | Yoshino | H03H 7/09 333/185 |
| 2013/0222101 | A1* | 8/2013 | Ito | H01F 17/04 336/83 |

(Continued)

FOREIGN PATENT DOCUMENTS

| | | | |
|---|---|---|---|
| JP | 2001-284125 | A | 10/2001 |
| JP | 2012-084936 | A | 4/2012 |
| KR | 10-2013-0104340 | A | 9/2013 |

*Primary Examiner* — Elvin G Enad

*Assistant Examiner* — Kazi S Hossain

(74) *Attorney, Agent, or Firm* — Morgan, Lewis & Bockius LLP

(57) ABSTRACT

A thin film type coil component that includes a body having a coil embedded therein and including a composite of magnetic powder particles and a polymer, and external electrodes disposed on at least portions of external surfaces of the body. The body includes an upper body portion disposed on an upper surface of the coil, a lower body portion disposed on a lower surface of the coil, and a central body portion disposed between the upper body portion and the lower body portion and including a central portion of the coil. The upper body portion and the lower body portion include a stacked structure of a plurality of magnetic sheets, each magnetic sheet including the composite of the magnetic powder particles and the polymer.

17 Claims, 13 Drawing Sheets

(56) References Cited

U.S. PATENT DOCUMENTS

| | | | | |
|---|---|---|---|---|
| 2014/0009254 | A1* | 1/2014 | Ohkubo | H01F 27/2804 336/192 |
| 2015/0109088 | A1* | 4/2015 | Kim | H01F 41/12 336/200 |
| 2016/0086716 | A1* | 3/2016 | Choi | H01F 27/292 336/221 |
| 2016/0163446 | A1* | 6/2016 | Park | H05K 9/0067 336/200 |
| 2016/0172098 | A1* | 6/2016 | Jeong | H01F 17/0013 336/90 |
| 2016/0268040 | A1* | 9/2016 | Kim | H01F 17/0013 |
| 2017/0287619 | A1* | 10/2017 | Sim | H01F 17/0013 |

* cited by examiner

THIN FILM TYPE COIL COMPONENT

CROSS-REFERENCE TO RELATED APPLICATION

This application claims priority under 35 U.S.C. § 119 to Korean Patent Application No. 10-2016-0107212, filed on Aug. 23, 2016, in the Korean Intellectual Property Office, the disclosure of which is incorporated herein by reference in its entirety.

BACKGROUND

1. Field

The present disclosure relates to a thin film type coil component such as a thin film type common mode filter.

2. Description of Related Art

With improvements in the performance of electronic devices, the amount of data (or information) traffic has increased, and the frequency of the data traffic has also increased. In order to ensure stable operation of the electronic devices, it is beneficial to improve the magnetic properties of electromagnetic compatibility (EMC) coil components, and to secure productivity of EMC coil components.

Particularly in a thin film type coil component including a ceramic substrate, coil plating layers and insulating layers are alternately formed on the ceramic substrate, thereby reducing a size of the thin film type coil component and improving high frequency characteristics by use of coil insulating layers. However, since the thin film type coil component uses a ceramic substrate, magnetic loss may occur, costs of manufacturing thin film type coil components may increase, and the yield of the thin film type coil component may decrease.

Some existing prior art common mode filters may use a magnetic substrate that includes a ceramic material. However, these existing filters also suffer from magnetic losses.

SUMMARY

An aspect of the present disclosure may provide a thin film type coil component which has improved electrical properties due to the absence of a ceramic substrate.

According to an aspect of the present disclosure, a thin film type coil component may include: a body having a coil embedded therein; and external electrodes disposed on at least portions of external surfaces of the body. The body may include an upper body portion disposed on an upper surface of the coil, a lower body portion disposed on a lower surface of the coil, and a central body portion disposed between the upper body portion and the lower body portion and including a central portion of the coil. The upper body portion and the lower body portion include a stacked plurality of magnetic sheets.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Hereinafter, thin film type coil components according to exemplary embodiments in the present disclosure will be described. The detailed description set forth below is intended as a description of various implementations and is not intended to represent the only implementations in which the subject technology may be practiced. As those skilled in the art would realize, the described implementations may be modified in various different ways, all without departing from the scope of the present disclosure. Accordingly, the drawings and description are to be regarded as illustrative in nature and not restrictive.

Thin Film Type Coil Component

Figure 1:
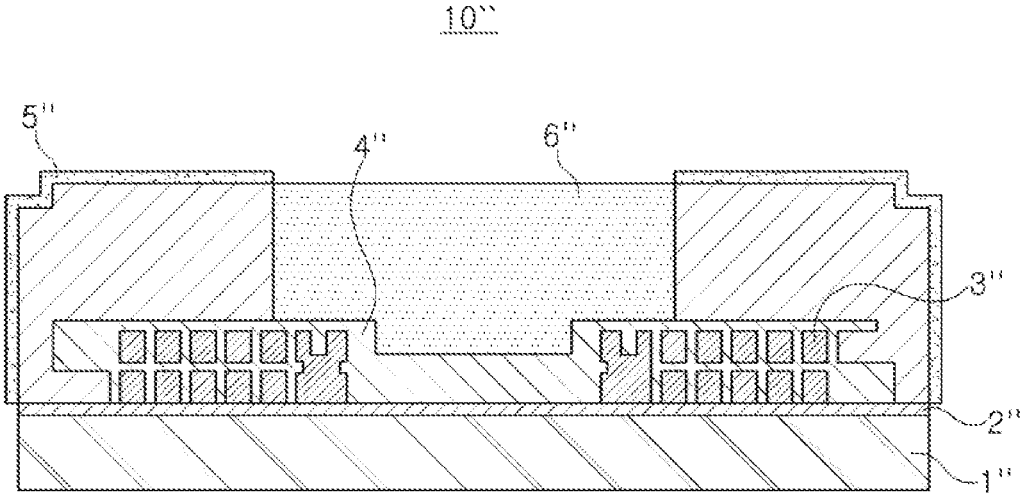
FIG. 1 is a schematic cross-sectional view of a thin film type common mode filter according to the related art and including a sintered ferrite substrate.

FIG. 1 is a schematic cross-sectional view of a thin film type coil component such as a thin film type common mode filter 10" according to the related art including a sintered ferrite substrate 1".

Referring to FIG. 1, the common mode filter 10", according to the related art, may include a sintered ferrite substrate 1" that may function as a base, a first insulating layer 2" disposed on the sintered ferrite substrate 1", internal electrodes 3" disposed on the first insulating layer 2", a second insulating layer 4" disposed on the first insulating layer 2" and covering the internal electrodes 3", external electrodes 5" disposed on the second insulating layer 4" and electrically connected to the internal electrodes 3", and a ferrite resin layer 6" disposed on the second insulating layer 4".

Miniaturizing the common mode filter 10" reduces a thickness of the sintered ferrite substrate 1" and causes cracks and other type of defects to be generated in the sintered ferrite substrate 1" with relative ease. Thus, handling the sintered ferrite substrate 1" is difficult, and a manufacturing yield is reduced. In addition, the locations and positions (orientation) where the external electrodes 5" may be disposed on the external surfaces of the sintered ferrite substrate 1" are limited, and a quality of a coil pattern may be deteriorated due to warpage of the circuit board including the common mode filter 10" . Further, the costs for manufacturing the sintered ferrite substrate 1" are significantly higher.

A thin film type coil component such as a common mode filter according to an exemplary embodiment in the present disclosure will hereinafter be described.

Figure 2:
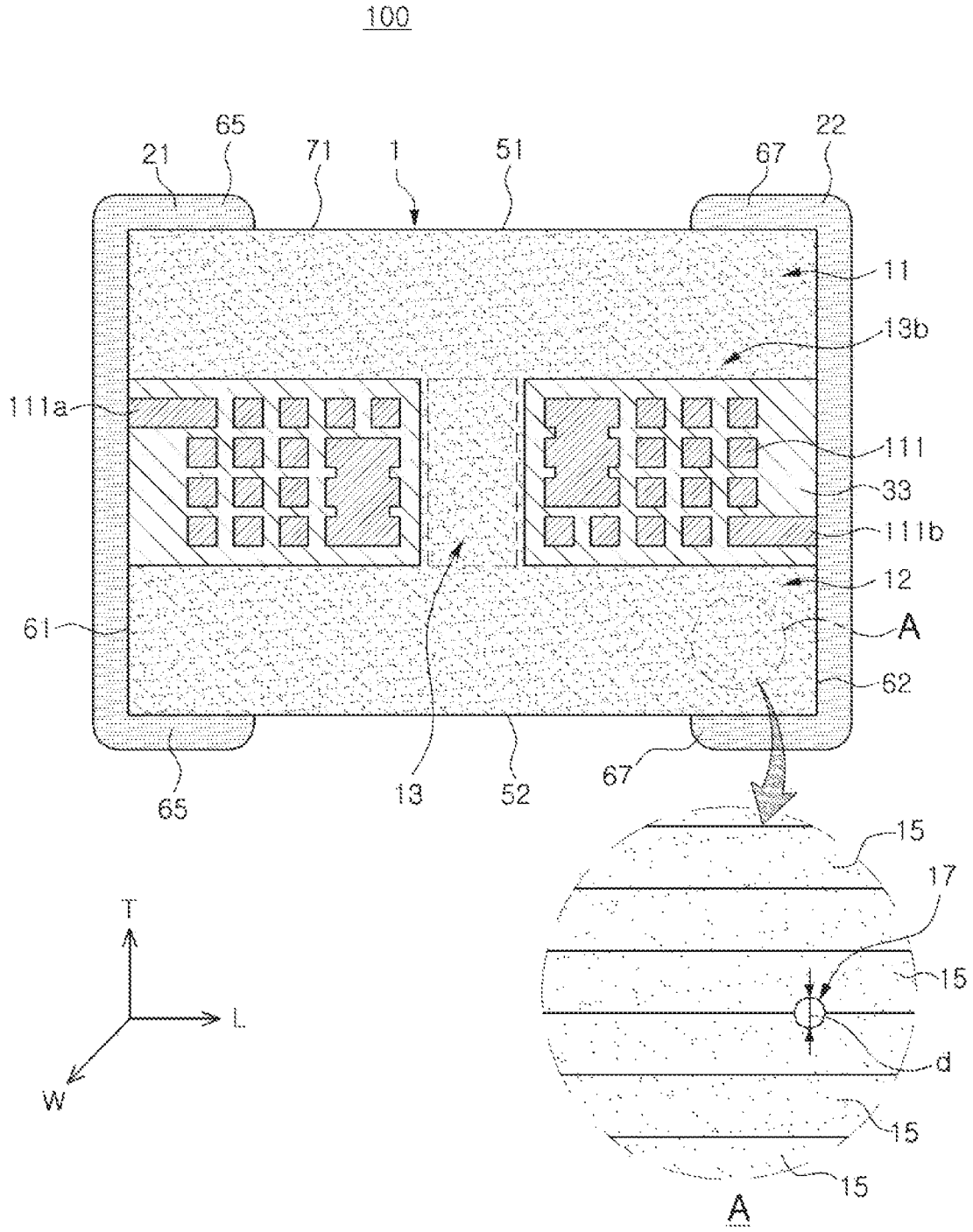
FIG. 2 is a schematic cross-sectional view of a common mode filter according to an exemplary embodiment in the present disclosure.

FIG. 2 is a schematic cross-sectional view of a common mode filter 100 according to an exemplary embodiment in the present disclosure. Referring to FIG. 2, the common mode filter 100 may include a body 1 having external electrodes 21 and 22 disposed on at least a portion of the external surface of the body 1.

The body 1 may have a generally hexahedral shape and may include upper and lower surfaces 51, 52 opposite each other in a thickness direction T, first and second side surfaces 61, 62 opposite each other in a length direction L, and third and fourth side surfaces 71, 72 (not seen in the cross-sectional view) opposite each other in a width direction W. However, the shape of the body 1 is not limited thereto, and the body may have any polyhedral shape, without departing from the scope of the disclosure. Herein, the upper and lower surfaces 51, 52 are with reference to the illustrative embodiment as depicted in FIG. 2, the upper surface 51 being toward the top of FIG. 2 and the lower surface 52 being toward the bottom of FIG. 2.

The body 1 may include an upper body portion 11, a lower body portion 12, and a central body portion 13 disposed between the upper body portion 11 and the lower body portion 12 in the thickness direction T. The upper body portion 11 may be disposed on an upper surface of a coil 111 embedded in an insulating layer 33 in the body 1, and the lower body portion 12 may be disposed on a lower surface of the coil 111. In an example, the coil 111 may include a metal such as copper (Cu), aluminum (Al), an alloy thereof, and the like. The central body portion 13 may be disposed between the upper body portion 11 and the lower body portion 12. The central body portion 13 may include a coil central portion 13*a*, which generally includes the center of the coil 111, and a coil outer portion 13*b*, which generally includes an outer or peripheral portion of the coil 111.

The body 1 may include a composite of magnetic powder particles and a polymer. The magnetic powder may be a powder that has magnetic properties, for example, ferrite powder. The polymer may be any material that may disperse the magnetic powder particles, for example, an epoxy resin. The magnetic powder particles may include spherical magnetic powder particles, flake-shaped magnetic powder particles, ribbon-shaped magnetic powder particles, a combination thereof, and the like.

The magnetic powder particles may be dispersed in a polymer resin.

Each of the upper body portion 11 and the lower body portion 12 of the body 1 may have a stacked structure including a plurality of magnetic sheets stacked on each other. The stacked structure is illustrated in the enlarged view of the region A of FIG. 2.

Referring to the enlarged view of region A of FIG. 2, the upper body portion 11 and the lower body portion 12 may include a plurality of magnetic sheets 15 that are stacked. In an example, the plurality magnetic sheets 15 may be stacked on each other and then the plurality of magnetic sheets 15 may be compressed in the thickness T direction. One or more voids 17 (one shown) maybe located at the boundary of adjacent magnetic sheets 15.

A diameter d of the void 17 may be about 1 μm or less, and the effect of the void 17 on the magnetic permeability of the body 1 may be negligible and can be ignored. However, when the diameter of the void 17 is greater than about 1 μm, the voids may affect (e.g., reduce) the magnetic permeability of the common mode filter 100.

Each magnetic sheet 15 may include a composite of magnetic powder particles and a polymer. The content of the magnetic powder particles in each magnetic sheet 15 maybe about 70 wt % to about 99 wt % of the composite. When the content of the magnetic powder particles is less than about 70 wt %, a sufficiently strong magnetic permeability may not be obtained. When the content of the magnetic powder particles is greater than about 99 wt %, it may be difficult to mold the composite into the magnetic sheet 15.

The magnetic powder particles may have spherical shapes, flake shapes, ribbon shapes, and combinations thereof. However, shapes of the magnetic powder particles can have any desired shape, without departing from the scope of the disclosure. For example, in a case in which the magnetic powder particles are ferrite, sintered ferrite particles may be pulverized, be processed in appropriate shapes, and then be mixed with the polymer resin. In order to improve magnetic permeability, a milling process may be performed on spherical ferrite powder particles.

Thicknesses of the upper and lower body portions 11 and 12 may be based on a size of a desired coil component. In an embodiment, a thickness of each of the upper body portion 11 and the lower body portion 12 may be about 60 μm to about 150 μm. The common mode filter 100 including the upper and lower body portions 11 and 12 having thickness of about 60 μm to about 150 μm may be used in a wide variety of chip sizes, and, as a result, the utilization of the common mode filter 100 is higher. When the upper body portion 11 and the lower body portion 12 have the same thickness, a loss of electrical properties of the common mode filter 100 may be minimized, and the reliability of the thin film type coil component may be improved.

The magnetic sheet 15, which is a composite of the magnetic powder particles dispersed in the polymer resin, may have a magnetic permeability of greater than about 1 to less than about 40. In general, the magnetic permeability of the sintered ferrite substrate 1" (FIG. 1) may be about 300. The magnetic permeability of the magnetic sheet 15 is not as high as that of the sintered ferrite substrate 1". Therefore, there may be impedance and attenuation losses in the magnetic sheet 15. However, when the magnetic permeability of the magnetic sheet is 1 or more, impedance and attenuation characteristics similar to those at the time of manufacturing a common mode filter may be obtained using the sintered ferrite substrate in a high frequency region of 1 GHz or more. In addition, the magnetic permeability of the magnetic sheet may be 40 or less. The reason is that flexibility of the magnetic sheet may not be appropriately given in a case in which the magnetic permeability of the magnetic sheet is greater than 40.

The external electrodes 21 and 22 may be disposed on the first and second side surfaces 61 and 62, respectively, of the body 1 in the length direction L, and may include band portions 65 and 67 extending from the first and second side surfaces 61 and 62 to portions of the upper surface 51 of the body 1 and portions of the lower surface 52 of the body 1. Unlike the external electrodes 21 and 22, the external electrodes 5" of FIG. 1 are not in contact with the sintered ferrite substrate 1" and are thus not continuous from an upper surface of the common mode filter 10" to a lower surface of the common mode filter 10". The external electrodes 21 and 22 may be continuously disposed from band portions 65 of the upper surface 51 of the body 1 to band portions 67 of the lower surface 52 of the body 1, such that a degree of freedom of a process for positioning the external electrodes 21 and 22 maybe improved and structural stability may be improved.

Figure 3A:
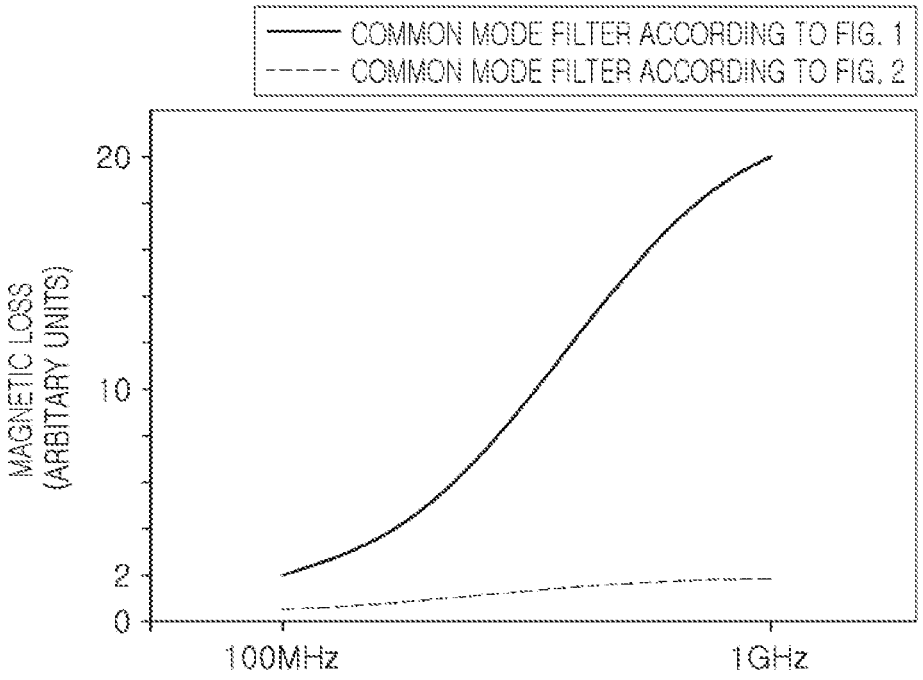
FIG. 3A illustrates a variation in magnetic losses with frequency in the common mode filter of FIG. 1 and a common mode filter of FIG. 2.
Figure 3B:
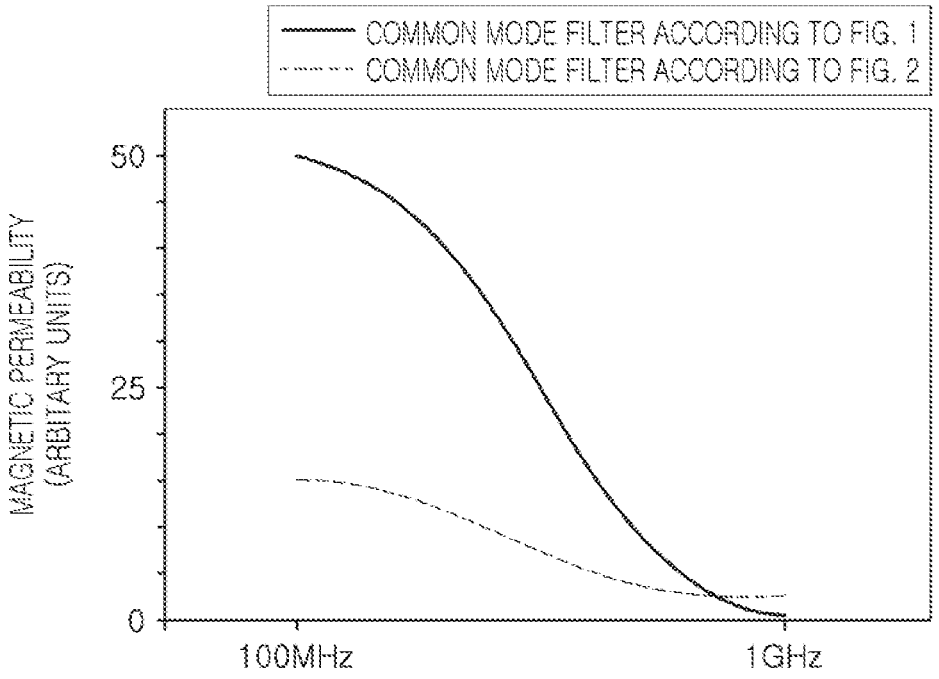
FIG. 3B illustrates a variation in magnetic permeability with frequency in the common mode filter of FIG. 1 and the common mode filter of FIG. 2.

FIG. 3A illustrates a variation in magnetic losses with frequency in the common mode filter 10" (FIG. 1) in which the sintered ferrite substrate 1" is disposed in a lower portion and a common mode filter 100 (FIG. 2) according to an exemplary embodiment in the present disclosure. FIG. 3B illustrates a variation in magnetic permeability with frequency in the common mode filter 10" (FIG. 1) and the common mode filter 100 (FIG. 2) according to an exemplary embodiment in the present disclosure.

Referring to FIG. 3A, magnetic losses of the common mode filter 10" maybe generally greater than that of the common mode filter 100 according to an exemplary embodiment in the present disclosure. This is due to the crystal structure of sintered ferrite substrate 1" which generates significant magnetic losses. As illustrated, as the frequency increases, the magnetic losses maybe significantly reduced in the common mode filter 100 according to an exemplary embodiment compared to the magnetic losses in common mode filter 10" including the sintered ferrite substrate 1".

Referring to FIG. 3B, magnetic permeability of the common mode filter 10" may be greater than that of the common mode filter 100 according to an exemplary embodiment in a low frequency range about 100 MHz. This is because the magnetic permeability of the sintered ferrite substrate 1" is higher in that frequency range. However, the applications of the common mode filter 100 are limited in the low frequency range about 100 MHz. In addition, magnetic permeability of the common mode filter 100 according to an exemplary embodiment may be higher than that of the common mode filter 10" according to the related art in a high frequency range about 1 GHz, which may indicate that the common mode filter 100 may have a substantially improved magnetic permeability in the high frequency region.

Figure 4:
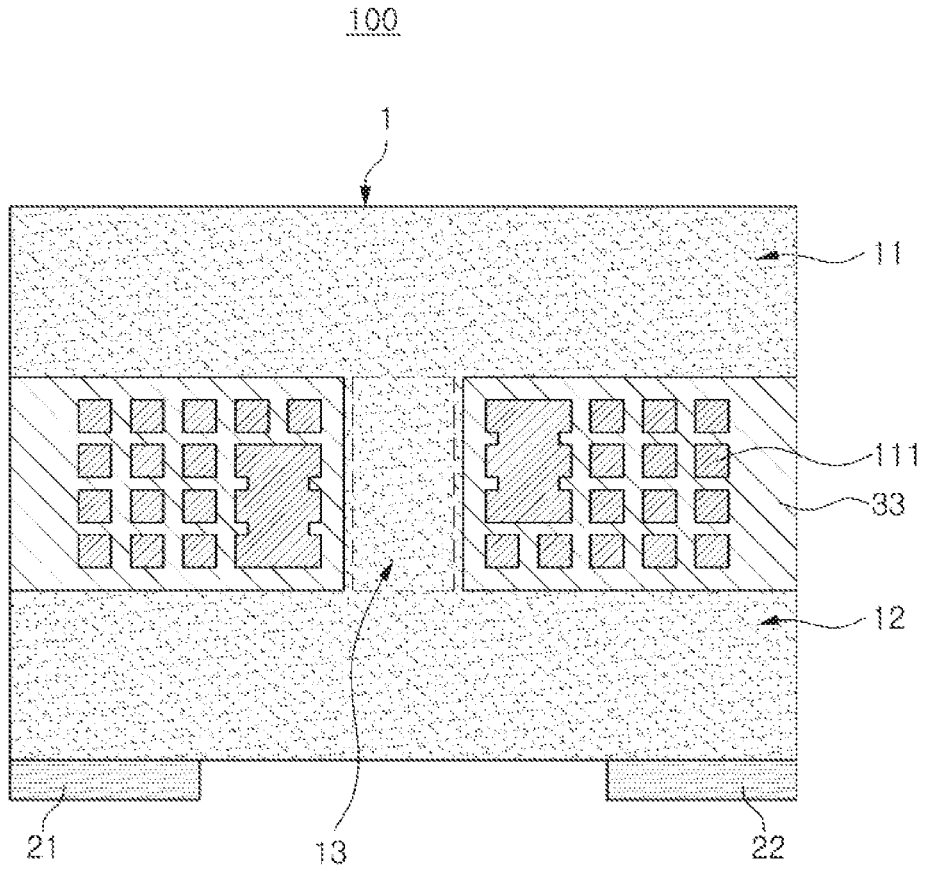
FIG. 4 is a schematic cross-sectional view of another embodiment of the common mode filter of FIG. 2.

FIG. 4 is a schematic cross-sectional view of another embodiment of the common mode filter 100 of FIG. 2, wherein the external electrodes 21 and 22 are disposed only on the lower surface 52 of the body 1.

Referring the FIG. 1, the process of disposing the external electrodes 5" on external surfaces of the sintered ferrite substrate 1" is relatively more complex, and the reliability of the resulting structure is relatively poor, considering the characteristics of a material of the sintered ferrite substrate 1". Therefore, in the common mode filter 10", the external electrodes 5" are generally not disposed on regions including the sintered ferrite substrate 1". When external electrodes are disposed on regions including the sintered ferrite substrate 1" in the common mode filter 10", the sintered ferrite substrate 1" and the external electrodes 5" may not couple with other, and the reliability of the common mode filter 10" is substantially reduced. However, as illustrated in FIG. 4, when the external electrodes 21 and 22 are disposed on the lower region of the common mode filter 100, an area occupied by the common mode filter 100 on a main board or printed circuit board (PCB) may be reduced and the external electrodes 21 and 22 may be omitted on side surfaces. Therefore, an additional magnetic material may be included in regions in which the external electrodes are absent in the common mode filter 100, and electrical properties of the common mode filter 100 may be improved.

Thus, an area occupied by the common mode filter 100 when mounted on a main board or PCB may be reduced and electrical properties of the common mode filter 100 may be improved. In comparison, the related art common mode filter 10" of FIG. 1 includes external electrodes 5" on only the side surfaces thereof, and the external electrodes 5" are absent on the sintered ferrite substrate 1".

Figure 5A:
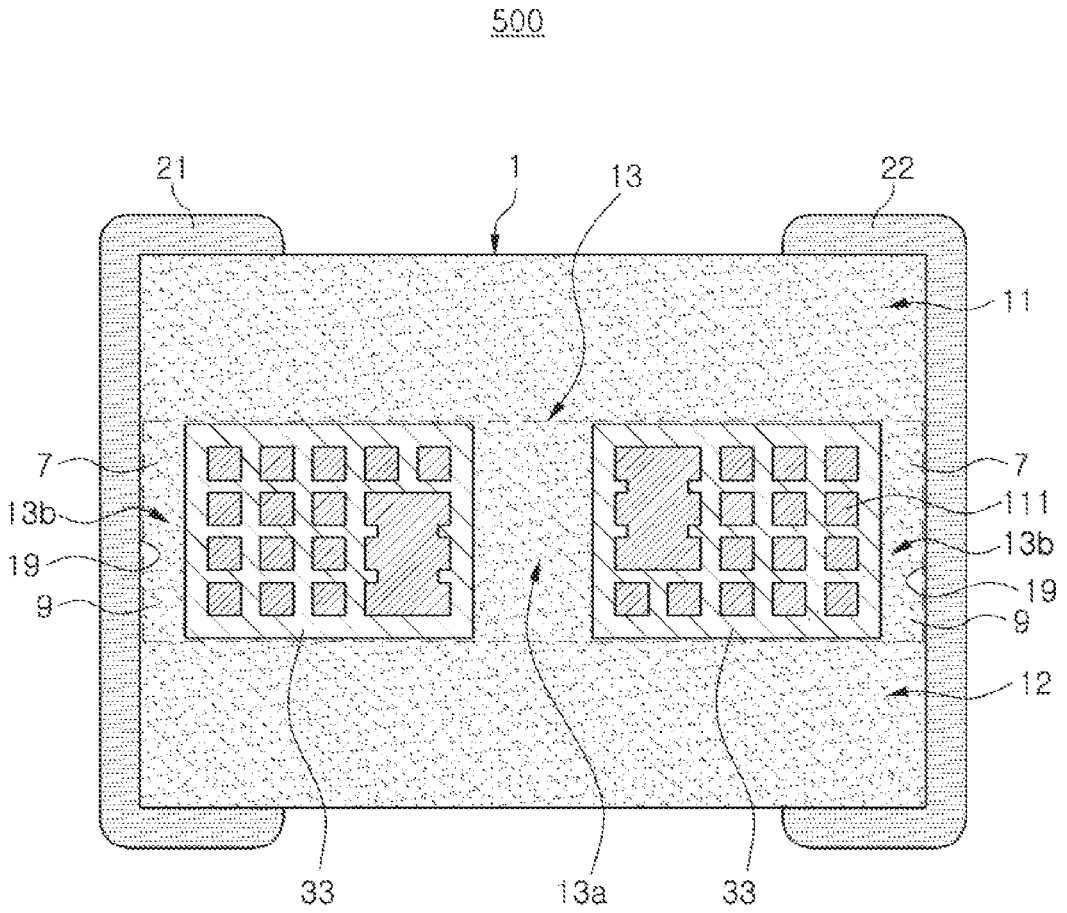
FIG. 5A is a cross-sectional view of another embodiment of a common mode filter.

FIG. 5A is a cross-sectional view of another embodiment of a common mode filter 500. The common mode filter 500 may be similar in some respects to the common mode filter 100 in FIG. 2, and therefore may be best understood with reference thereto where like numerals designate like components not described again in detail.

In the common mode filter 500, the coil outer portion 13*b* (or at least a portion thereof) of the central body portion 13 may include a composite of magnetic powder particles and a polymer resin In an example and as illustrated, the coil outer portion 13*b* of the central body portion 13 may include a through-hole 19 penetrating through the entire insulating layer 33 in the thickness direction T. An extension 7 of the upper body portion 11 and an extension 9 of the lower body portion 12 may be disposed in the through-hole 19 and the extensions 7 and 9 may contact each other in the through-hole 19. Thus, the through-hole 19 may be filled with the composite of magnetic powder particles and polymer included in the body 1. In this case, the entirety of the coil outer portion 13*b* may include the composite.

Figure 5B:
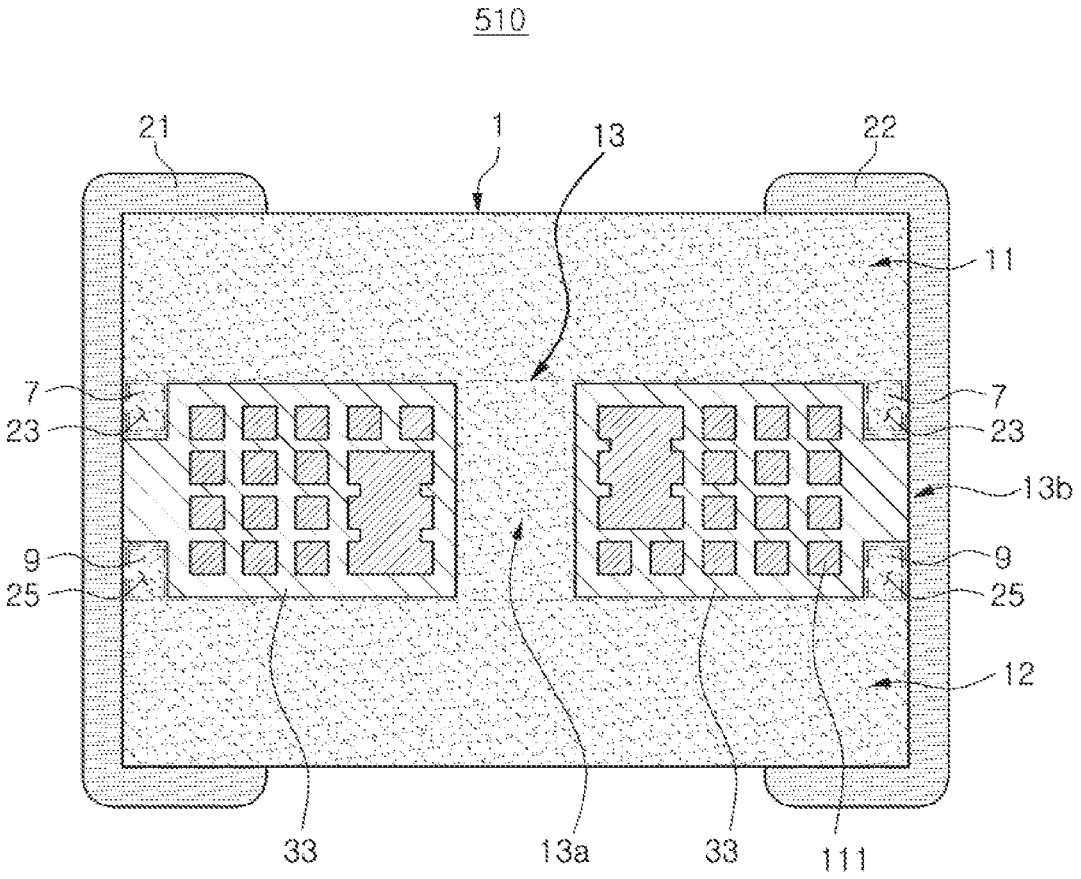
FIG. 5B is a cross-sectional view of another embodiment of the common mode filter.

FIG. 5B is a cross-sectional view of another embodiments of a common mode filter 510. The common mode filter 510 may be similar in some respects to the common mode filter 500 in FIG. 5A, and therefore may be best understood with reference thereto where like numerals designate like components not described again in detail.

Referring to FIG. 5B, instead of the through-hole 19, the coil outer portion 13*b* may include a first trench 23 extending in the thickness T direction from the upper body portion 11 towards the lower body portion 12, and a second trench 25 extending in the thickness T direction from the lower body portion 12 towards the upper body portion 11. As illustrated, the trenches 23 and 25 may surround the insulating layer 33 and a portion of the insulating layer 33 is located between the trenches 23 and 25. The extension 7 of the upper body portion 11 may be disposed in the trench 23 and the extension 9 of the lower body portion 12 may be disposed in the trench 25. Thus, the trenches 23 and 25 are filled with the composite of magnetic powder particles and polymer. As illustrated, the extensions 7 and 9 do not contact each other. In this case, at least some of the coil outer portion 13*b* may include the insulating layer 33.

The composite may be included in the coil outer portion 13*b* using a variety of methods known in the art. For example, the coil outer portion 13*b* may include the composite, and the upper body portion 11 and the lower body portion 12 may include the stacked plurality of magnetic sheets 15. Alternatively, a slurry of the magnetic powder particles and the polymer resin may fill the coil outer portion 13*b*.

By introducing the composite including the magnetic powder particles in the coil outer portion 13*b*, the electrical properties of the common mode filters 500 and 510 may be improved compared to the electrical properties of the common mode filter 200 having the composite including the magnetic powder particles only in the coil central portion 13*a*.

Figure 6:
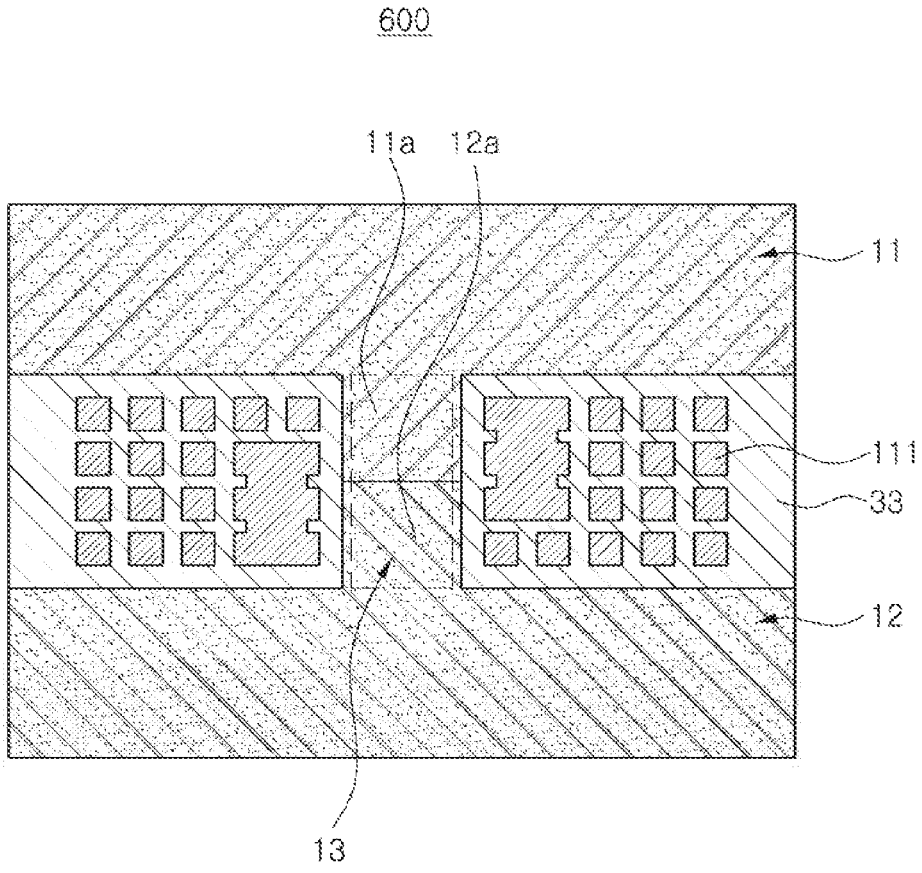
FIG. 6 is a cross-sectional view of yet another embodiment of a common mode filter.

FIG. 6 is a cross-sectional view of yet another embodiment of a common mode filter 600. The common mode filter 600 may be similar in some respects to the common mode filter 100 in FIG. 2, and therefore may be best understood with reference thereto where like numerals designate like components not described again in detail.

As illustrated, in the common mode filter 600, the upper body portion 11 and the lower body portion 12 extend into the central body portion 13. Specifically, the coil central portion 13*a* of the central body portion 13 may include an upper body extended portion 11*a* of the upper body portion 11 and a lower body extended portion 12*a* of the lower body portion 12. The upper body extended portion 11*a* and the lower body extended portion 12*a* may include the plurality of magnetic sheets 15 stacked on each other. In an example, the upper body extended portion 11*a* and the lower body extended portion 12*a* may be formed by applying a predetermined pressure on upper body portion 11 and the lower body portion 12 in the thickness direction T. As a result, some of the plurality of magnetic sheets 15 of the upper body portion 11 may be pushed down and introduced into the coil central portion 13*a,* and some of the plurality of magnetic sheets 15 of the lower body portion 12 may be pushed up and introduced into the coil central portion 13*a.*

The common mode filter 600 is then hardened by heating at a predetermined temperature, thereby causing the upper body extended portion 11*a* and the lower body extended portion 12*a* to merge with each other at the interface therebetween in the coil central portion 13*a*. Thus, a discrete boundary between the upper body extended portion 11*a* and the lower body extended portion 12*a* is absent and the upper body portion 11, the lower body portion 12, and the central body portion 13 form a single undivided integrated structure. Herein, an external shape of the body 1 may be substantially similar to that of the common mode filter 600, but an internal structure of the body 1 may include have a cavity having the coil 111 and the insulating layer 33 surrounding the coil 111 disposed therein.

When the upper body extended portion 11*a* and the lower body extended portion 12*a* merge with each other, the number of voids (e.g., voids 17 in FIG. 2) may be substantially reduced and, any voids present may be not affect the characteristics and performance of the common mode filter 600 and a presence thereof may be ignored.

FIGS. 7A-7E illustrate processing steps for manufacturing a thin film type coil component such as the common mode filter 100, according to an exemplary embodiment in the present disclosure. However, the common mode filters 500, 510, and 600 may also be manufactured similarly, without departing from the scope of the disclosure.

Figure 7A:
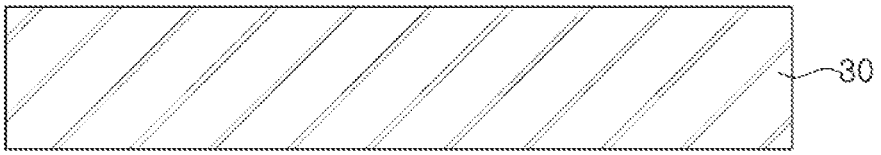
FIGS. 7A-7E illustrate processing steps for manufacturing a thin film type coil component.

As illustrated in FIG. 7A, a core 30 may be prepared. As discussed further below, the core 30 may be removed after the common mode filter 100 has been manufactured.

Figure 7B:
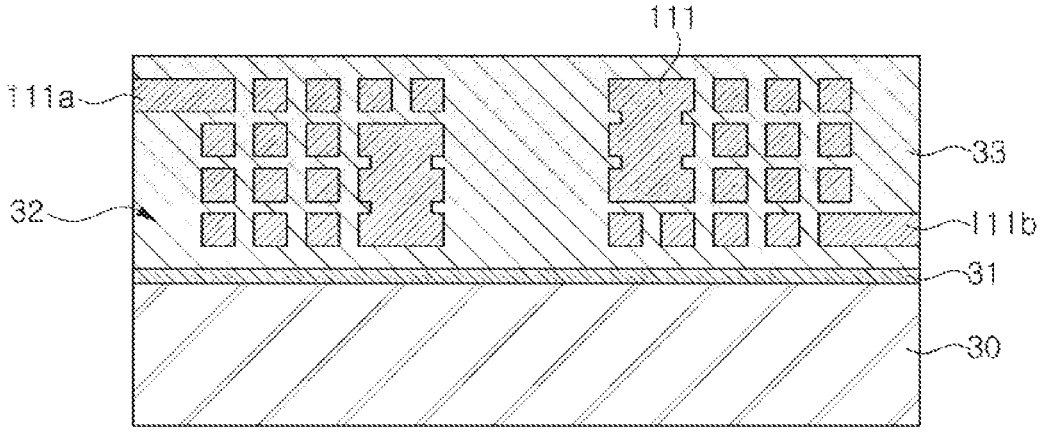

As illustrated in FIG. 7B, a metal layer 31 may be formed on one surface of the detachable core 30, and a coil layer 32 may be formed on one surface of the metal layer 31 using one or more methods known in the art. Then, an insulating layer 33 may be formed on the coil layer 32. The process may be repeated to form a coil 111. The lead portions 111*a* and 111*b* may be formed to electrically connect the coil 111 to external electrodes.

The metal layer 31 may be formed of the same metal as that of the coil, for example, copper (Cu).

The insulating layers 33 may be stacked using a build-up film of ABF, polyimide, epoxy, benzocyclobutene (BCB), and the like.

Figure 7C:
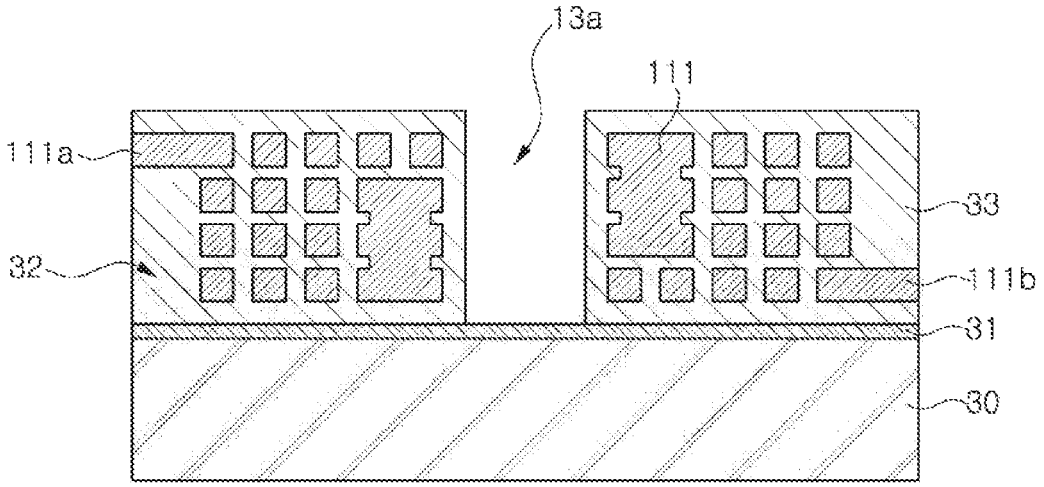

As illustrated in FIG. 7C, laser processing (or similar process) may be performed for obtaining an appropriate coil shape. For instance, the laser processing may be used to form a through-hole for forming a coil central portion 13*a* of the coil 111.

Figure 7D:
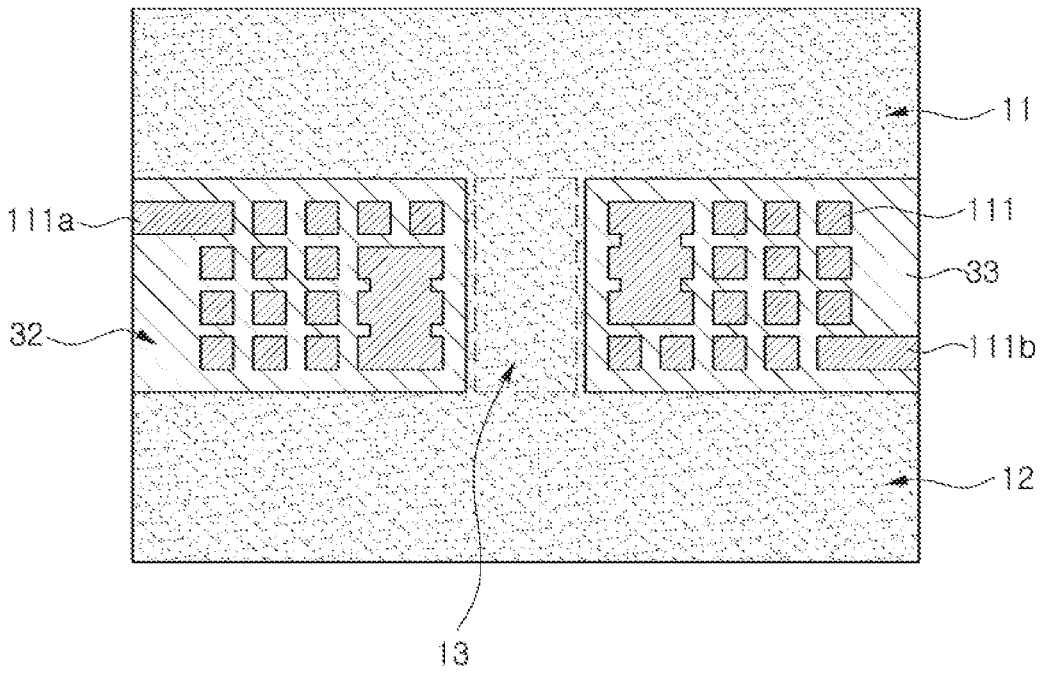

As illustrated in FIG. 7D, the core 30, which may be used as a support substrate, and the metal layer 31 may be removed (e.g., using etching or similar process). A plurality of magnetic sheets (e.g., magnetic sheets 15 in FIG. 2) may be stacked on upper and lower surfaces of the coil 111, and may be compressed in the thickness direction T, and the upper body portion 11 and the lower body portion 12 may be formed.

Figure 7E:
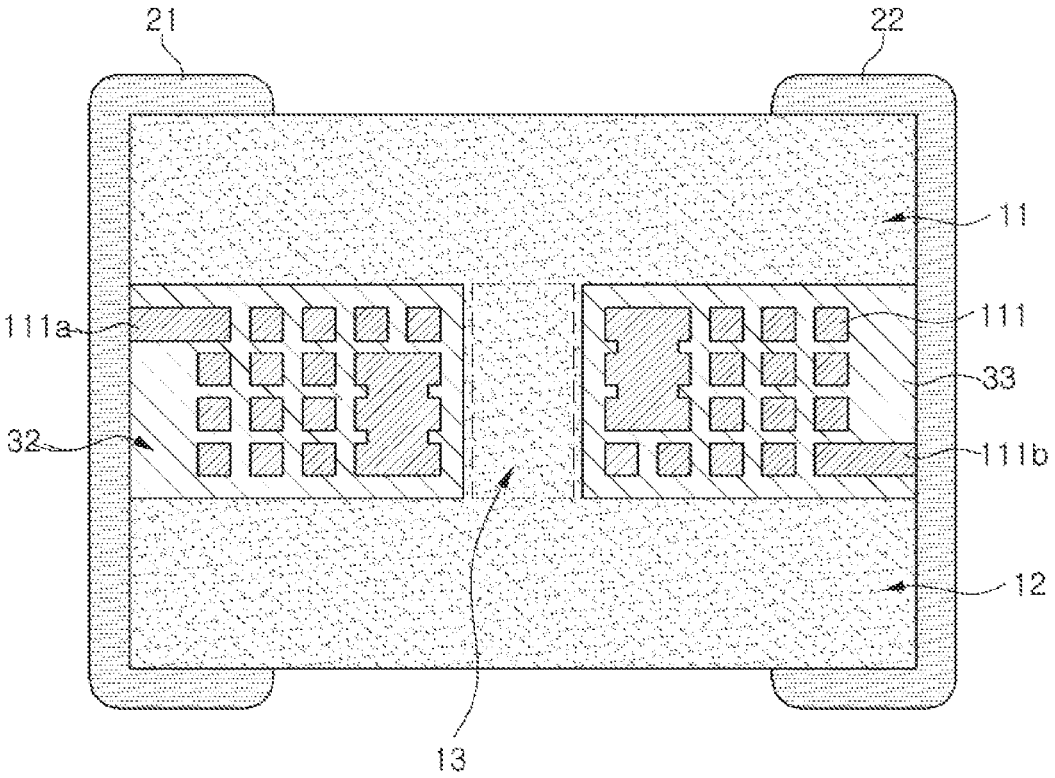

Then, as illustrated in FIG. 7E, post-processing steps such as lower surface grinding, dicing, or the like, may be performed, and external electrodes 21 and 22 may be formed and connected to the lead portions 111*a* and 111*b* of the coil 111 to complete the common mode filter 100.

As mentioned above, it may be difficult to handle the common mode filter 10" including the sintered ferrite substrate 1" during manufacture since cracks and other defects may be easily developed in the common mode filter 10". The common mode filter 100 manufactured using the process of FIGS. 7A-7E may not require a sintered ferrite substrate, and thus the common mode filter 100 may be handled (e.g., during manufacture) with relative ease. Due to the difficulty in handling the common mode filter 10", the manufacturing costs of the common mode filter 10" are higher. However, in the common mode filter 100 manufactured through the process of FIGS. 7A through 7E, the sintered ferrite substrate may be omitted, and thus the common mode filter 100 may be mass-produced at a reduced cost, a process yield may be increased, and a size of the thin film type coil component may be relatively larger.

In addition, because the sintered ferrite substrate is absent in the common mode filter 100, the locations where the external electrodes may be disposed may be increased, and deterioration of quality of a coil due to warpage of a circuit board including the common mode filter 100 may be reduced.

As set forth above, according to the disclosed exemplary embodiments, a sintered ferrite substrate is not used, and therefore associated drawbacks are substantially reduced.

In addition, according to the disclosed exemplary embodiments, thin film type coil components that may be manufactured at a reduced cost, the process is economically efficient, and the manufactured thin film type coil components may have improved electrical properties.

While exemplary embodiments have been shown and described above, it will be apparent to those skilled in the art that modifications and variations could be made without departing from the scope of the present disclosure, as defined by the appended claims.

What is claimed is:

1. A thin film type coil component, comprising:

a body having a coil embedded therein and including a composite of magnetic powder particles and a polymer; and external electrodes disposed on at least portions of external surfaces of the body, wherein the body includes an upper body portion disposed on an upper surface of the coil, a lower body portion disposed on a lower surface of the coil, and a central body portion disposed between the upper body portion and the lower body portion and including a central portion of the coil, the upper body portion and the lower body portion include a plurality of magnetic sheets, each magnetic sheet including the composite of the magnetic powder particles and the polymer, and wherein at least one void is defined at an interface between adjacent magnetic sheets, the voids having a diameter of 1 μm or less.

2. The thin film type coil component of claim 1, wherein the magnetic powder particles are ferrite powder particles.

3. The thin film type coil component of claim 1, wherein the polymer is an epoxy resin.

4. The thin film type coil component of claim 1, wherein the central body portion includes an upper body extended portion of the upper body portion that extends toward the lower surface of the coil, and a lower body extended portion of the lower body portion that extends toward the upper surface of the coil.

5. The thin film type coil component of claim 1, wherein the upper body portion, the lower body portion, and the central body portion are integrated with one another and form an undivided integrated structure.

6. The thin film type coil component of claim 1, wherein the central body portion includes a coil outer portion, and a through-hole is defined in the coil outer portion, the through-hole including magnetic powder particles and the polymer.

7. The thin film type coil component of claim 6, wherein an extension of the upper body portion and an extension of the lower body portion are disposed in the through-hole, and the extension of the upper body portion and the extension of the lower body portion contact each other in the through-hole.

8. The thin film type coil component of claim 1, wherein the central body portion includes a coil outer portion, and a first trench and a second trench are defined in the coil outer portion, the first and second trenches including magnetic powder particles and the polymer.

9. The thin film type coil component of claim 8, wherein an extension of the upper body portion is disposed in the first trench and an extension of the lower body portion is disposed in the second trench.

10. The thin film type coil component of claim 1, wherein the magnetic powder particles include spherical magnetic powder particles flake-shaped magnetic powder particles, ribbon-shaped magnetic powder particles, or combinations thereof.

11. The thin film type coil component of claim 1, wherein a content of the magnetic powder particles included in the magnetic sheet is about 70 wt% to about 99 wt% of the composite.

12. The thin film type coil component of claim 1, wherein a thickness of the upper body portion is about 60 μm to about 150 μm, and a thickness of the lower body portion is about 60 μm to about 150 μm.

13. The thin film type coil component of claim 1, wherein the magnetic sheet has magnetic permeability of about 1 to about 40.

14. The thin film type coil component of claim 1, wherein the external electrodes are disposed on a lower surface of the body.

15. The thin film type coil component of claim 1, wherein the external electrodes are disposed on side surfaces of the body and include band portions disposed on upper and lower surfaces of the body.

16. The thin film type coil component of claim 1, wherein the coil includes a stacked plurality of coil layers, and an insulating layer surrounding the stacked plurality of coil layers.

17. The thin film type coil component of claim 16, wherein the insulating layer includes polyimide, an epoxy resin, or benzocyclobutene (BCB).

* * * * *